US009079195B2

(12) United States Patent
Todteberg et al.

(10) Patent No.: US 9,079,195 B2
(45) Date of Patent: Jul. 14, 2015

(54) ROTOR FOR A LABORATORY CENTRIFUGE WITH ROTOR HUB COOLING MEANS

(71) Applicant: SIGMA LABORZENTRIFUGEN GMBH, Osterode (DE)

(72) Inventors: Eckhard Todteberg, Osterode (DE); Matthias Bittner, Gottingen (DE)

(73) Assignee: SIGMA LABORZENTRIFUGEN GMBH, Osterode (DE)

( * ) Notice: Subject to any disclaimer, the term of this patent is extended or adjusted under 35 U.S.C. 154(b) by 0 days.

(21) Appl. No.: 14/368,293

(22) PCT Filed: Jul. 24, 2013

(86) PCT No.: PCT/EP2013/002188

§ 371 (c)(1),
(2) Date: Jun. 23, 2014

(87) PCT Pub. No.: WO2014/029458

PCT Pub. Date: Feb. 27, 2014

(65) Prior Publication Data

US 2014/0349829 A1 Nov. 27, 2014

(30) Foreign Application Priority Data

Aug. 24, 2012 (DE) ..... 20 2012 008 062 U

(51) Int. Cl.

| | |
|---|---|
| ***B04B 15/02*** | (2006.01) |
| ***B04B 5/04*** | (2006.01) |
| ***B04B 7/08*** | (2006.01) |

(Continued)

(52) U.S. Cl.

CPC ..... *B04B 15/02* (2013.01); *B04B 5/0414* (2013.01); *B04B 7/02* (2013.01); *B04B 7/08* (2013.01); *B04B 2007/025* (2013.01); *B04B 2009/085* (2013.01)

(58) Field of Classification Search

CPC ..... B04B 15/02
USPC ..... 494/13, 14, 16–21, 23, 25–26, 60; 210/175, 180; 422/72

See application file for complete search history.

(56) References Cited

U.S. PATENT DOCUMENTS 2,878,992 A * 3/1959 Pickels et al. ..... 494/14
2,917,229 A * 12/1959 Di Benedetto et al. ..... 494/14

(Continued)

FOREIGN PATENT DOCUMENTS

DE 1029299 * 9/1954
DE 10316897 A1 * 11/2004 ..... B04B 9/00

(Continued)

*Primary Examiner* — Charles Cooley
(74) *Attorney, Agent, or Firm* — Jennifer S. Stachniak; Robert W. Becker

(57) ABSTRACT

A rotor body (3) for a laboratory centrifuge includes a rotor hub (14) which is inserted in a central opening and on the outside of which, at least one helically curve continuous groove (27) runs so as to form a transport facility for cooling air. The cooling air is effective in the direction of the axis (2) of the rotor hub (14) between the upper side (23) and the underside (22) of the rotor (1). In this manner, a cooling airstream which runs axially through the rotor (1) and undergoes direct thermal exchange with the rotor (1) and the mixtures to be treated in the laboratory centrifuge can be realized. No additional installation volume is required for this measure and equalization of the temperature of the rotor and the housing accommodating the rotor can be achieved.

10 Claims, 3 Drawing Sheets

(51) Int. Cl.
*B04B 7/02* (2006.01)
*B04B 9/08* (2006.01)

(56) References Cited

U.S. PATENT DOCUMENTS 3,148,146 A * 9/1964 Asnes et al. ..... 494/1
3,860,166 A * 1/1975 Anderson ..... 494/13
4,193,536 A * 3/1980 Kubota ..... 494/14
4,221,325 A * 9/1980 Kubota ..... 494/14
5,490,830 A * 2/1996 Lovelady et al. ..... 494/14
6,068,586 A * 5/2000 Koch et al. ..... 494/14
7,192,394 B1 * 3/2007 Karl ..... 494/14
7,371,205 B2 * 5/2008 Andersson et al. ..... 494/14
2006/0142134 A1 * 6/2006 Andersson et al. ..... 494/14
2014/0349829 A1 * 11/2014 Todteberg et al. ..... 494/60

FOREIGN PATENT DOCUMENTS

DE 102004058247 A1 * 6/2006
EP 455876 A2 * 11/1991 ..... B04B 15/02
EP 0592354 A2 9/1993
EP 0592354 A3 9/1993
WO 2007134624 A1 11/2007

* cited by examiner

ROTOR FOR A LABORATORY CENTRIFUGE WITH ROTOR HUB COOLING MEANS

The instant application should be granted the priority dates of Aug. 24, 2012, the filing date of the corresponding German patent application DE 20 2012 008 062.8, as well as Jul. 24, 2013, the filing date of the international patent application PCT/EP2013/002188.

The invention relates to the rotor of a laboratory centrifuge.

BACKGROUND OF THE INVENTION

Laboratory centrifuges consist of a housing that is closable with a cap, in which a rotor connected to an electric drive unit is suspended in such manner that it is able to oscillate. The peripheral region of the rotor is furnished with a series of holders, into which receptacles intended as containers for a substance mixture that is to be centrifuged may be placed. The rotor is further equipped with a rotor hub, by means of which it may be fitted onto a drive shaft inside the housing. Centrifuging must often be carried out under certain thermal conditions, taking into account the chemico-physical properties of the substance mixture, so the interior space of the rotor and housing must be in a correspondingly conditioned state. It is known to equip such centrifuges, more particularly the housings thereof, with corresponding heating and/or cooling systems, particularly including a refrigerant circuit. However, in order to obtain constant thermal conditions for the rotor, the interior of the centrifuge and the substance mixture to be treated, it is also necessary to implement particular structural measures, which are relatively expensive.

SUMMARY OF THE INVENTION

In view of the preceding, the object of the invention is to design a rotor for a laboratory centrifuge with which the thermal conditions in the housing interior, the rotor, and consequently also the substance mixture to be treated can easily be made constant.

According to the above, it is essential to the invention that the hub of the rotor has undergone special adaptation so that it also functions as a feed element that is intended to provide a media stream, for example a coolant medium, particularly cooling air, which is directed both axially and centrally relative to the rotor. For this purpose, the exterior of the rotor hub is provided with at least one, preferably multiple helical grooves configured for the purpose of exercising a transporting effect in the manner of an axial fan, a spiral conveyor or the like. In this context, a plurality of helical grooves may be arranged in the manner of a thread having two or more starts. A media stream passing axially through the rotor is in direct thermal exchange with the rotor, and thus also with the substance mixtures to be treated. Accordingly, no additional installation space is required, and this arrangement is suitable for creating constant thermal conditions for the rotor as well as for the housing in which the rotor is accommodated.

The grooves extend between the two frontal face ends of the rotor hub, which consists of an annular flange and a fastening element conformed integrally therewith. The medium is thus directed via the peripheral areas of the rotor hub, the central area thereof being ad adapted for attachment to a drive shaft. In this way, the rotor hub is not prevented from performing its intended function.

The configuration of the feed element is advantageous in many cases, since this makes it possible, for example, to provide a cooling air stream that flows through the rotor from the top to the bottom thereof. The subsequent guidance of the cooling air or any other medium may be arranged in a circuit in the housing or even in conjunction with the surrounding atmosphere in any manner desired.

A variation of the rotor consists of a rotor body, a cap, a cap screw, a specially designed nut and the rotor hub. It is evident that the cap can be removed by loosening the cap screw without otherwise interfering with the integrity of the rotor.

The nut has two internal threads, one of which is designed for a screw connection with the cap screw, and the other for screw connection with the rotor hub or the fastening element thereof. The end face of the fastening element is retained within the nut at a distance from the end face of the part that is connected to the cap screw. This ensures that a media flow is not impeded by the radially outer grooves of the rotor hub due to the threaded connection thereof with the nut.

In each case, a continuous, axially directed central flow path through the rotor is set up, which includes the radially outer grooves of the rotor hub and the cap screw. The cap screw consists of a plate-like disc for the purpose of actuation and a hollow cylindrical element arranged thereon, which element is inserted in a central opening in the disc, thereby creating an axial passage through the cap screw.

The sealed annular gap is formed between the cap and the rotor body. This variation is possible because the feed element according to the invention is located close to the axis of the rotor.

The present invention also is directed to the installation of the rotor hub with no axial play.

It may be seen from the foregoing notes that the rotor according to the invention represents as device that is notable for its simple construction and which serves as a contribution to improved and particularly consistent guidance of a medium, particularly for the uniform thermal conditioning of the rotor of a laboratory centrifuge, including the substance mixture to be treated.

BRIEF DESCRIPTION OF THE DRAWINGS

The invention will be explained in greater detail in the following with reference to the exemplary embodiment represented schematically in the drawing. In the drawing.

DETAILED DESCRIPTION OF SPECIFIC EMBODIMENTS

Figure 1:
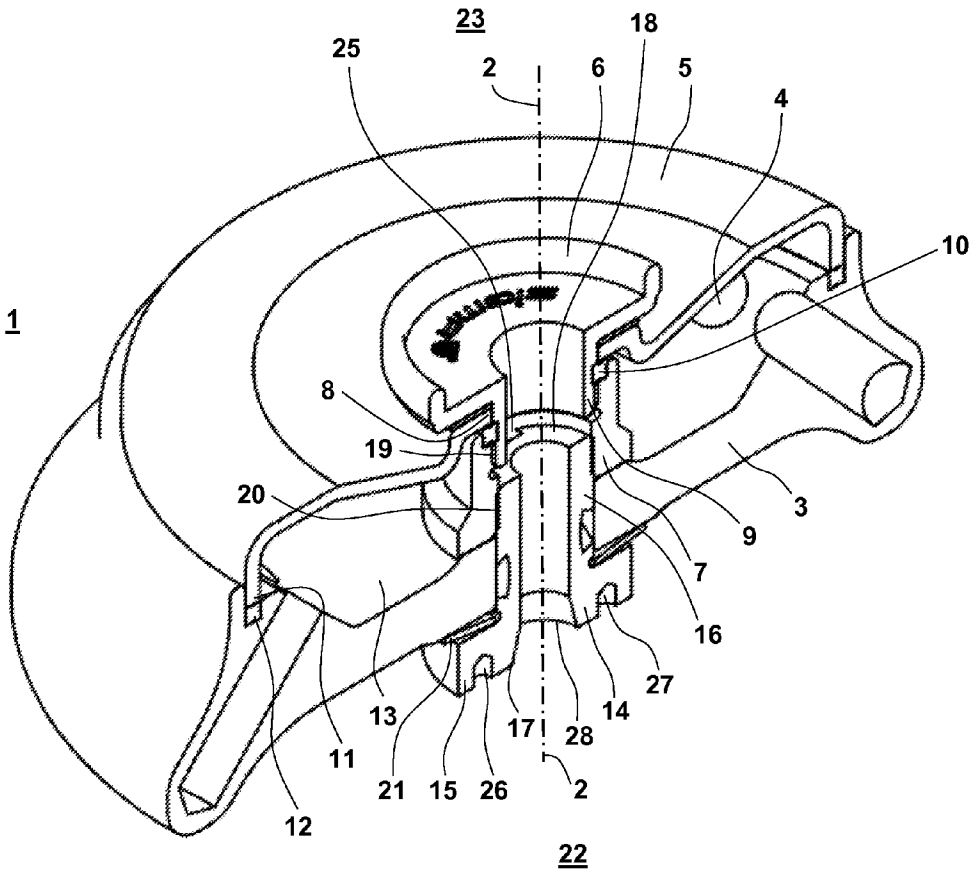
FIG. 1 is a partial perspective view of the rotor of a laboratory centrifuge in an axial cross sectional plane.
Figure 2:
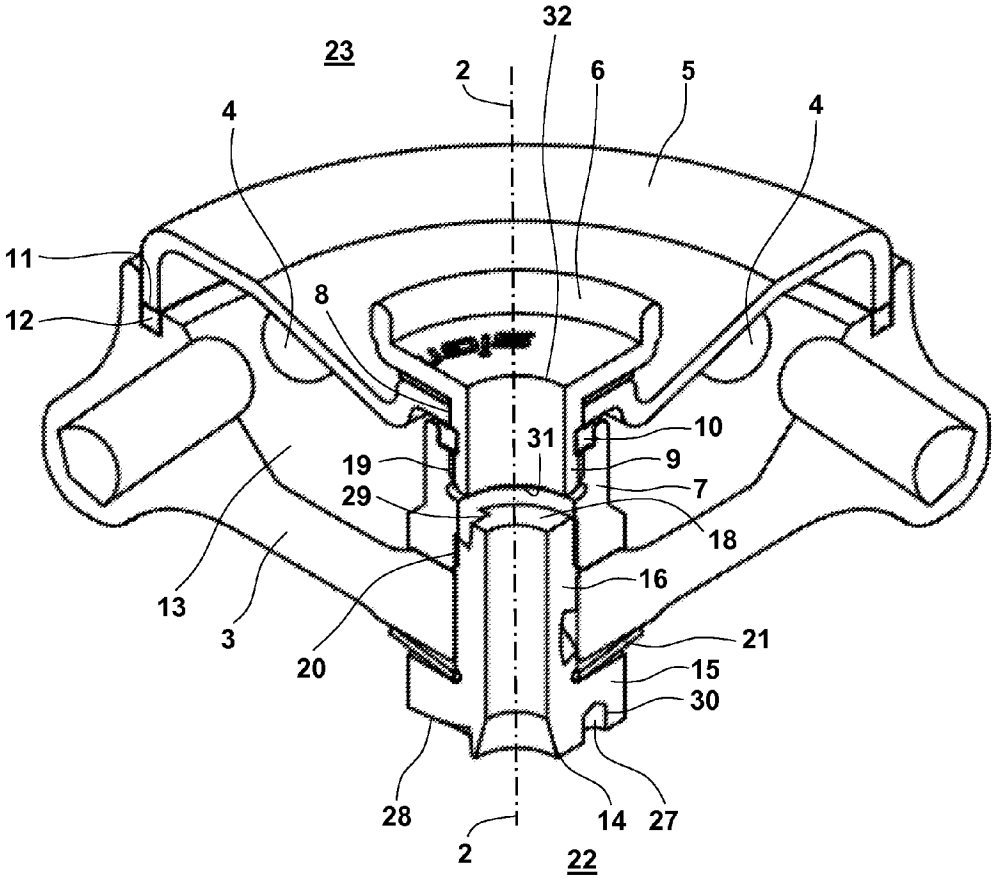
FIG. 2 is a partial perspective view of the rotor of a laboratory centrifuge in two mutually perpendicular cross sectional planes.
Figure 3:
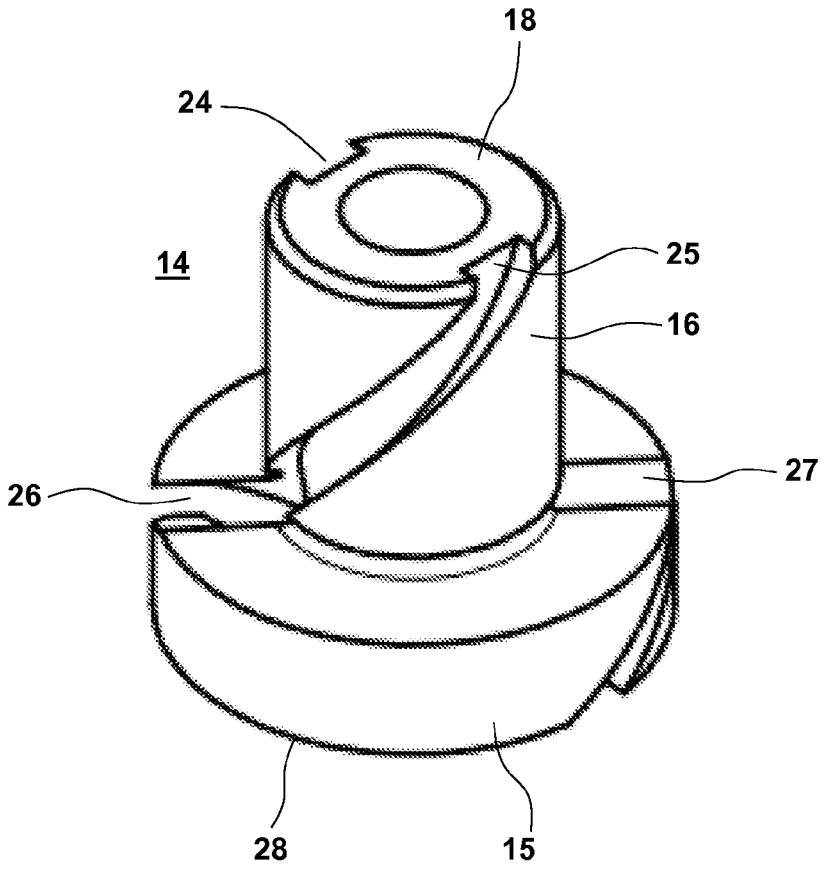
FIG. 3 is a perspective, separate, enlarged view of the rotor hub according to FIG. 1 or 2.

Reference sign 1 in FIGS. 1 and 2 designates a rotor of a laboratory centrifuge that is not further illustrated, which rotor is of rotationally symmetrical construction about axis 2 thereof. Said rotor consists of a rotor body 3, the peripheral region of which includes holders 4, which are intended in known manner to accommodate receptacles filled with a substance mixture intended for treatment by centrifuging.

Reference sign 5 denotes a cap that covers rotor body 3 and is screwed to a nut 7 located below cap 5 by means of a cap screw 6 that is aligned coaxially with axis 2. A hollow cylindrical element 9 with an external thread extending through a cutout 8 in cap 5 and abutting with cap screw 6 engages with an internal thread 19 of nut 7. A sealing ring 10, preferably in the form of a four-lip seal, is positioned between cap 5 and nut 7, accommodated in annular recesses that are located radially opposite one another.

The rim of cover 5 has a bowl-like shape with an open curve toward rotor body 3, and the free edge 11 of which lies flush with a further sealing ring 12, which is seated in an annular recess in rotor body 3. This sealing ring 12 is preferably also designed as a four-lip seal. It may be seen that in this way a sealed annular gap 13 extending around nut 7 is created between the upper side of rotor body 3 and the facing lower side of cap 5.

Reference sign 14 designates a rotor hub consisting of an annular flange 15 and a hollow cylindrical attachment, element 16 arranged thereon, which attachment element, when installed, protrudes through an opening 17 in rotor body 3 and into nut 7. End face 18 thereof is located inside 7 and at a distance from the opposing face end 31 of element 9 of cap screw 6.

Attachment element 16 has an external thread that engages with a further internal thread 20 of nut 7. Annular flange 15 is placed under tension with rotor body 3 due to the interposition of a plate spring 21, wherein a compound structure is created with nut 7 via internal thread 20.

Rotor hub 14, in particular the attachment element 16 thereof, is furnished on the radially outer side with two diametrically opposed helical grooves 25, 26, which have the same pitch and extend through an angle of approximately 90°. Grooves 25, 26 have an approximately rectangular cross-sectional profile and are continued in the outer contour of annular flange 15 as local grooves 26, 27. In this way, two continuous, helical channels are created in the manner of a thread with two starts, beginning in free end face 28 of annular flange 15 and terminating in free end face 18 of attachment element 16.

Thus, a dual connection is created between an underside 22 and an upper side 23 of rotor 1 via rotor hub 14, particularly grooves 25 to 27 therein, and cap screw 6, particularly element 9 thereof, which rotor can be fitted on a drive shaft inside a centrifuge housing by means of rotor hub 14.

When rotor hub 14 is installed, the system of grooves 24 to 27 performs the function of a feed element in the manner of an axial fan or spiral conveyor, which, depending on the operating speed of rotor 1 and the design of the pitch of grooves 24 to 27, rising counterclockwise in the embodiment shown, creates a pressure gradient starting from the upper inlet openings 29 in grooves 24, 25 in the space between end face 18 of rotor hub 14 and the end face 31 of element 9 of cap screw 6 opposite thereto, until the lower outlet openings 30 in grooves 26, 27. This pressure gradient creates an airflow through rotor 1 that is coaxial with axis 2, on the intake side through opening 32 in element 9 of cap screw 6 and rotor hub 4, and on the outlet side through output openings 30, thus from the upper side 23 to the underside 22 of rotor 1, which may undergo further treatment inside the centrifuge housing.

The further treatment of the media flow created in this way, especially an airflow, may be carried out in conjunction with cooling equipment in circuit, in which the rotor hub 14 described previously is integrated. It may also consist of discharging warm air into the surrounding atmosphere and replacing at least some of said warm air with cooler, fresh air. Finally, it may be used in conjunction with a heating device and for controlling the temperature of the rotor. In all these cases, thermal control over rotor 1 is enabled, starting from the near-axis areas thereof and, concomitantly therewith, homogenisation of the conditions for treatment of the substance mixture.

The specification incorporates by reference the disclosure of German patent application DE 20 2012 008 062.8, filed Aug. 24, 2012, as well as PCT/EP2013/002188, filed Jul. 24, 2013.

The present invention is, of course, in no way restricted to the specific disclosure of the specification and drawings, but also encompasses any modifications within the scope of the appended claims.

List of reference signs

| | |
|---|---|
| 1 | Rotor |
| 2 | Axis |
| 3 | Rotor body |
| 4 | Holder |
| 5 | Cap |
| 6 | Cap screw |
| 7 | Nut |
| 8 | Cutout |
| 9 | Element |
| 10 | Sealing ring |
| 11 | Edge |
| 12 | Sealing ring |
| 13 | Annular gap |
| 14 | Rotor hub |
| 15 | Annular flange |
| 16 | Attachment element |
| 17 | Opening |
| 18 | End face |
| 19 | Internal thread |
| 20 | External thread |
| 21 | Plate spring |
| 22 | Underside |
| 23 | Upper side |
| 24 | Groove |
| 25 | Groove |
| 26 | Groove |
| 27 | Groove |
| 28 | End face |
| 29 | Intake opening |
| 30 | Outlet opening |
| 31 | End face |
| 32 | Opening |

The invention claimed is:

1. A rotor for a laboratory centrifuge, comprising:

a rotor body having a central opening;

a plurality of holders provided in a peripheral area of said rotor body, wherein said holders are configured to contain a substance mixture for treatment by centrifuging;

a rotor hub inserted in the central opening of the rotor body;

at least one helically winding, uninterrupted groove formed in an outer side of the rotor hub, wherein the at least one groove extends between an inlet opening in the at least one groove and an outlet opening in the at least one groove, the inlet opening being located at an upper end of the rotor hub and the outlet opening being located at a lower end of the rotor hub, thereby forming a feed device effective in a direction of an axis of the rotor in the manner of an axial fluid work machine between an upper side and lower side of the rotor.

2. The rotor according to claim 1, wherein the rotor hub consists of an annular flange configured to lie flush with an underside rim of the opening and a hollow, cylindrical attachment element that is inserted into the opening, wherein the at least one groove extends between an upper end face of the attachment element at the upper end of the rotor hub and a lower end face of the annular flange at the lower end of the rotor hub.

3. The rotor according to claim 2, further comprising a nut that is screwed to the attachment element via an internal thread on the upper side of the rotor body.

4. The rotor according to claim 3, further comprising a cap screw that is screwed into an internal thread of the nut via a hollow cylindrical element formed in said cap screw.

5. The rotor according to claim 4, wherein the end face of the attachment element is arranged at a distance from an end face of the cylindrical element inside the nut.

6. The rotor according to claim 4, wherein the cap screw and the rotor hub form a central, uninterrupted axial flow path.

7. The rotor according to claim 2, further comprising a spring element arranged between the annular flange and the rim of the opening.

8. The rotor according to claim 1, wherein a pitch of the at least one groove is set depending on a direction of rotation of the rotor, such that the feed device has an axial direction of feed from the upper side of the rotor toward the lower side of the rotor.

9. The rotor according to claim 1, further comprising a cap covering an upper side of the rotor body, said cap defining an annular gap between the cap and the rotor body, wherein said gap is coaxial with the axis of the rotor.

10. The rotor according to claim 9, wherein the annular gap is sealed at an inner rim and outer rim of the cap via sealing rings.

* * * * *